US008727816B2

(12) United States Patent
Takahashi et al.

(10) Patent No.: US 8,727,816 B2
(45) Date of Patent: May 20, 2014

(54) CONNECTOR

(75) Inventors: Kazuhide Takahashi, Makinohara (JP); Toshifumi Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 99 days.

(21) Appl. No.: 13/504,245

(22) PCT Filed: Feb. 4, 2011

(86) PCT No.: PCT/JP2011/052959
§ 371 (c)(1),
(2), (4) Date: Apr. 26, 2012

(87) PCT Pub. No.: WO2011/096591
PCT Pub. Date: Aug. 11, 2011

(65) Prior Publication Data

US 2012/0214358 A1 Aug. 23, 2012

(30) Foreign Application Priority Data

Feb. 5, 2010 (JP) ..... 2010-023912

(51) Int. Cl.
*H01R 13/514* (2006.01)

(52) U.S. Cl.
USPC ..... 439/752; 439/595

(58) Field of Classification Search
USPC ..... 439/595, 752
See application file for complete search history.

(56) References Cited

U.S. PATENT DOCUMENTS

| | | | | |
|---|---|---|---|---|
| 5,516,308 | A * | 5/1996 | Yamanashi | 439/752 |
| 5,897,402 | A | 4/1999 | Sasai et al. | |
| 5,928,038 | A * | 7/1999 | Berg et al. | 439/752 |
| 6,200,172 | B1 * | 3/2001 | Konoya et al. | 439/752 |
| 6,322,391 | B1 * | 11/2001 | Kodama | 439/595 |
| 8,096,841 | B2 * | 1/2012 | Hirano | 439/752 |
| 2003/0119339 | A1 | 6/2003 | Bae | |
| 2007/0093131 | A1 | 4/2007 | Takahashi et al. | |
| 2008/0119091 | A1 | 5/2008 | Nishide | |
| 2009/0130902 | A1 | 5/2009 | Hall et al. | |

FOREIGN PATENT DOCUMENTS

| | | | |
|---|---|---|---|
| EP | 0822616 | A2 | 2/1998 |
| EP | 1923962 | A1 | 5/2008 |
| JP | 2007115614 | A | 5/2007 |
| WO | 2009064484 | A1 | 5/2009 |

OTHER PUBLICATIONS

International Search Report dated May 20, 2012 issued in International Application No. PCT/JP2011/052959 (PCT/ISA/210).
International Search Report dated May 20, 2012 issued in International Application No. PCT/JP2011/052959 (PCT/ISA/237).

* cited by examiner

*Primary Examiner* — Renee S Luebke
*Assistant Examiner* — Larisa Tsukerman
(74) *Attorney, Agent, or Firm* — Sughrue Mion, PLLC

(57) ABSTRACT

A connector includes a plurality of metal terminals, a connector housing and a spacer. The connector housing respectively receives the metal terminals, has a plurality of terminal accommodating chambers which are aligned in parallel therein and are partitioned with a partition wall each other, and has a first outer wall which is formed with a first opening and a second outer wall which is formed with a second opening. The spacer is inserted into the plurality of terminal accommodating chambers through the first opening so as to hold the plurality of metal terminals so that the metal terminals are prevented from withdrawal from the connector housing, and has a superposing wall which extends toward the second outer wall. The superposing wall superposes on the partition wall and a distal end portion of the superposing wall is located within the second opening.

4 Claims, 7 Drawing Sheets

CONNECTOR

TECHNICAL FIELD

This invention is related to a connector provided with a spacer for holding metal terminals, which are received in terminal accommodating chambers, to prevent the metal terminals from withdrawal from the terminal accommodating chambers.

BACKGROUND ART

Various kinds of electronic equipments are mounted on a vehicle. Wire harnesses are installed in the vehicle so as to transmit electric power and control signals to the electronic equipments. The wire harness comprises a plurality of wires and connectors secured to end portions of the wires. The connector comprises metal terminals electrically connected to the end portions of the wires, and a connector housing having terminal accommodating chambers for respectively receiving the metal terminals. This connector of the wire harness is fitted to a connector of the electronic equipment, and transmits electric power and the control signals to this electronic equipment.

As one example of the above connector, there is known a connector 101 (see PTL 1) as shown in FIGS. 5 and 6 which comprises two metal terminals 2 electrically connected respectively to end portions of wires 5, a connector housing 103 for receiving these metal terminals 2, and a spacer 104 which is inserted into the connector housing 103 through an opening 105 formed in an outer wall of the connector housing 103, and holds the two metal terminals 2, thereby preventing the metal terminals 2 from withdrawal from the connector housing 103.

The connector housing 103 includes retaining reception portions 107 for respectively retaining retaining portions 106 of the spacer 104, and two terminal accommodating chambers 109 for respectively receiving the two metal terminals 2. The two terminal accommodating chambers 109 are formed by a plurality of outer walls of the connector housing 103 and a partition wall 110 dividing an internal space defined by these outer walls. The two terminal accommodating chambers 109 are arranged side-by-side in a direction perpendicular to a direction of insertion of the metal terminals 2 into the respective terminal accommodating chambers 109. The opening 105 is formed in the outer wall facing the two terminal accommodating chambers 109. In order that the spacer 104 can be received in the connector housing 103, that end portion of the partition wall 110 disposed close to the opening. 105 is removed or notched. With this construction, the two terminal accommodating chambers 109 communicate with each other at their portions disposed close to the opening 105.

The spacer 104 includes a body portion 111 for holding the two metal terminals 2, the retaining portions 106 for retaining engagement with the respective retaining reception portions 107, and insertion ports 108 for the insertion of a jig 200 thereinto so as to remove the spacer 104 from the connector housing 103. For removing the spacer 104 from the connector housing 103, the jig 200 is inserted into the insertion port 108, and then is brought down to prize the spacer 104 out as shown in FIG. 5.

CITATION LIST

Patent Literature

[PTL 1] JP-A-2007-115614

SUMMARY OF INVENTION

Technical Problem

The above conventional connector 101 has been often used in lubricating oil within an automatic transmission. Foreign matters, such as metallic powder or the like resulting from worn gears, are suspended in the lubricating oil within the automatic transmission. There has been encountered a problem that the foreign matter can intrude into the connector housing 103 through the insertion ports 108. In addition, each insertion port 108 is provided so as to extend over the two terminal accommodating chambers 109, and therefore there has been encountered a problem that when the foreign matter intrudes into the connector housing 103 through the insertion port 108, it is possible that this small piece of foreign matter may deposit on both of the two metal terminals 2 to cause short-circuiting between these metal terminals.

Incidentally, the Applicant of the present application has already filed a patent application (Japanese Patent Application No. 2005-308250) covering a connector (shown in FIGS. 7 and 8) for preventing the short-circuiting between the metal terminals due to the deposition of a foreign matter. This connector 201 comprises two metal terminals 2, a connector housing 203, and a spacer 204 which is inserted into the connector housing 203 through an opening 205 formed in an outer wall of the connector housing 203.

The connector housing 203 includes retaining reception portions 107 for retaining engagement respectively with retaining portions 106 of the spacer 204, and two juxtaposed terminal accommodating chambers 209. The two terminal accommodating chambers 209 are formed by a plurality of outer walls of the connector housing 203 and a partition wall 210 dividing an internal space defined by these outer walls. The opening 205 is formed through the outer wall facing the two terminal accommodating chambers 209. In order that the spacer 204 can be received in the connector housing 203, a notch 210*a* of a generally U-shape is formed in that edge of the partition wall 210 disposed close to the opening 205. With this construction, the two terminal accommodating chambers 209 communicate with each other at their portions disposed close to the opening 205.

The spacer 204 includes a body portion 211 for holding the two metal terminals 2, the retaining portions 106 for retaining engagement with the respective retaining reception portions 107, insertion ports 208 for the insertion of a jig thereinto so as to remove the spacer 204 from the connector housing 203, and channel-shaped grooves 212 into which those portions 210*b* of the partition wall 210 disposed respectively at opposite ends of the notch 210*a* are fitted, respectively.

The insertion ports 208 are provided so as not to extend over the two terminal accommodating chambers 209, and each insertion port 208 communicates only with the corresponding terminal accommodating chamber 209. Communication between the insertion port 208 and the other terminal accommodating chamber 209 is interrupted by the portions 210*b* of the partition wall 210 (which are disposed respectively at the opposite ends of the notch 210*a*) and the body portion 211.

In this connector 201, the communication between the insertion port 208 and the other terminal accommodating chamber 208 is interrupted by the portions 210*b* and the body portion 211 as described above, and therefore a foreign matter such as metallic power or the like intruding into the connector housing 203 through the insertion port 208 is prevented from depositing on both of one metal terminal 2 received in one terminal accommodating chamber 209 and the other metal terminal 2 received in the other terminal accommodating chamber 209, and the short-circuiting between the metal terminals can be prevented.

It is therefore one advantageous aspect of the present invention is to provide a connector in which the effect of preventing the short-circuiting between metal terminals due to the deposition of a foreign matter is further enhanced.

Solution to Problem

According to one aspect of the present invention, there is provided A connector comprising:

a plurality of metal terminals;

a connector housing, configured to respectively receive the metal terminals, having a plurality of terminal accommodating chambers which are aligned in parallel therein and are partitioned with a partition wall each other, and having a first outer wall which is formed with a first opening and a second outer wall which is opposite to the first outer wall and is formed with a second opening; and a spacer, configured to be inserted into the plurality of terminal accommodating chambers through the first opening so as to hold the plurality of metal terminals so that the metal terminals are prevented from withdrawal from the connector housing, and having a superposing wall which extends toward the second outer wall, wherein the superposing wall is configured to superpose on the partition wall and a distal end portion of the superposing wall is located within the second opening, in a state where the spacer is inserted in the terminal accommodating chambers.

The connector may be configured such that a width of one of the terminal accommodating chambers through which the superposing wall is passed is larger than a width of another one of the terminal accommodating chambers through which the superposing wall is not passed by a thickness of the superposing wall.

The connector may be configured such that: the spacer has an insertion port for insertion of a jig used when removing the space from the connector housing; and the insertion port communicates with only one of the terminal accommodating chambers.

The connector may be configured such that: the partition wall has a notch on an edge facing the first opening; the spacer is formed with a pair of slits which extend from opposite end portions of the spacer in a direction orthogonal to a direction in which the terminal accommodating chambers are aligned; and in the state where the spacer is inserted in the terminal accommodating chambers, end portions of the partition wall which are adjacent to opposite ends the notch are configured to be inserted into the slits respectively.

Advantageous Effects of Invention

According to the aspect of the present invention, the connector housing has the second opening formed through the second outer wall opposed to the first outer wall, and the spacer has the superposing wall which extends toward the second outer wall and is superposed on the partition wall separating the adjoining terminal accommodating chambers from each other, and when the spacer is inserted in the connector housing, the distal end portion of the superposing wall is located within the second opening. Therefore, the partition wall, extending perpendicularly from the second outer wall toward the first outer wall, and the superposing wall extending toward the second outer wall from the portion of the spacer disposed close to the first outer wall are disposed between the adjoining terminal accommodating chambers in such a manner that the partition wall and the superposing wall extend in the opposite directions, respectively. Therefore, in order that a foreign matter such as metallic power or the like intruding into the connector housing can move from one of the adjoining terminal accommodating chambers to the other, the foreign matter must advance on the surface of the partition wall and the surface of the superposing wall as switch-backing, and there is hardly a possibility that the foreign matter reaches the other terminal accommodating chamber from the one terminal accommodating chamber. Also, during the time when the foreign matter moves on the surface of the partition wall and the surface of the superposing wall, the foreign matter is discharged to the exterior of the connector housing through the second opening, and therefore there is hardly a possibility that the foreign matter reaches the other terminal accommodating chamber from the one terminal accommodating chamber. Therefore, a small piece of foreign matter can be positively prevented from depositing on both of the adjoining metal terminals. Therefore, there can be provided the connector in which the short-circuiting between the metal terminals which would be caused by the foreign matter intruding into the connector housing can be positively prevented.

According to the invention, the width of the terminal accommodating chamber, among the plurality of terminal accommodating chambers, through which the superposing wall is passed is larger by an amount equal to the thickness of the superposing wall than the width of the terminal accommodating chamber through which the superposing wall is not passed. Therefore, an extra space is prevented from being formed within each terminal accommodating chamber, and the connector housing is prevented from increasing in size

DESCRIPTION OF EMBODIMENTS

One embodiment of a connector of the present invention will now be described with reference to FIGS. 1 to 4. The connector 1 of the present invention forms a wire harness installed in a vehicle or the like. The connector of this embodiment is used in lubricating oil within an automatic transmission of the vehicle.

Figure 1:
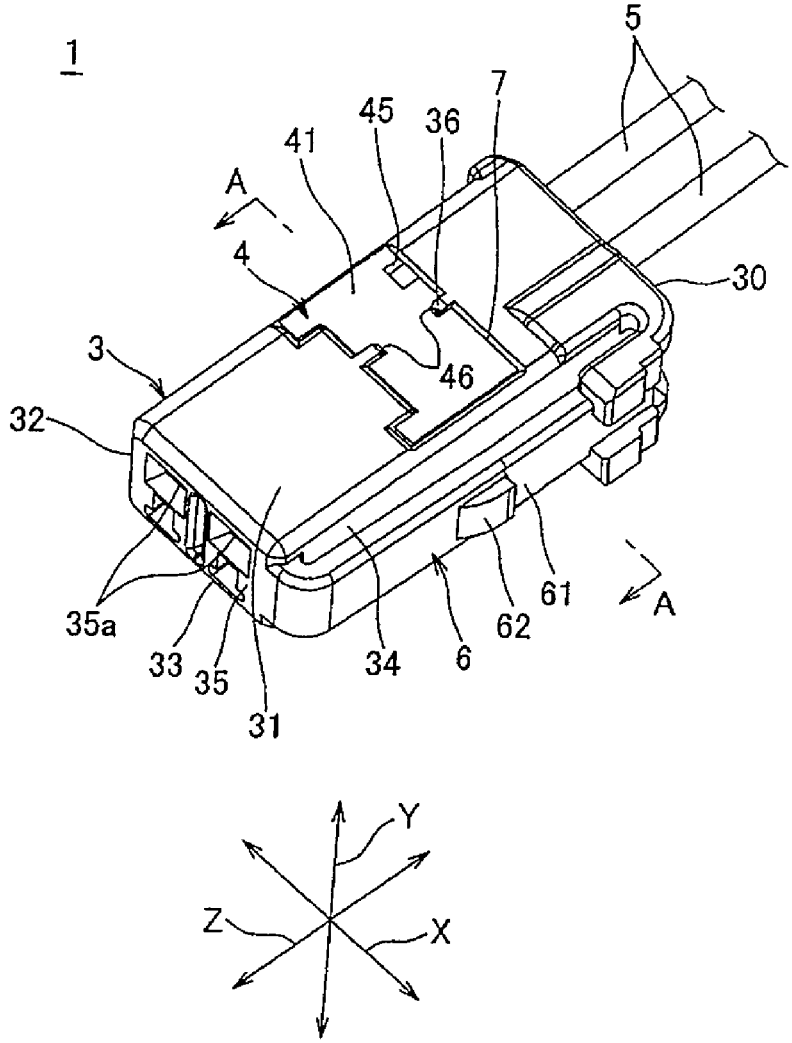
FIG. 1 is a perspective view showing one embodiment of a connector of the present invention.
Figure 2:
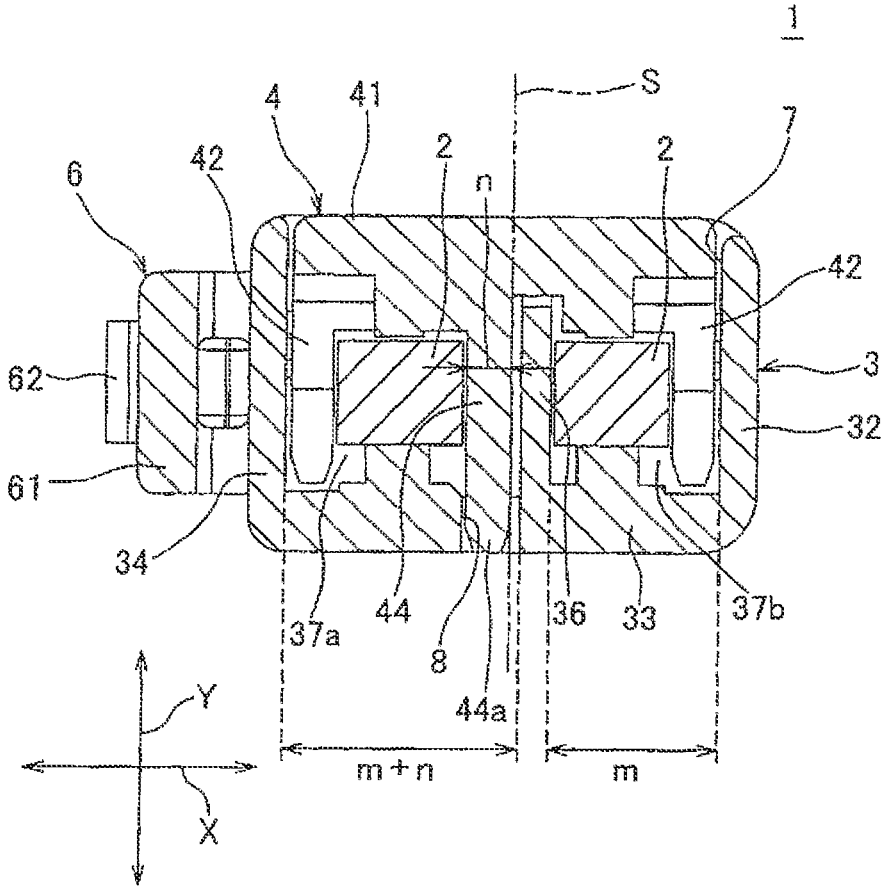
FIG. 2 is a cross-sectional view taken along the line A-A of FIG. 1.
Figure 3:
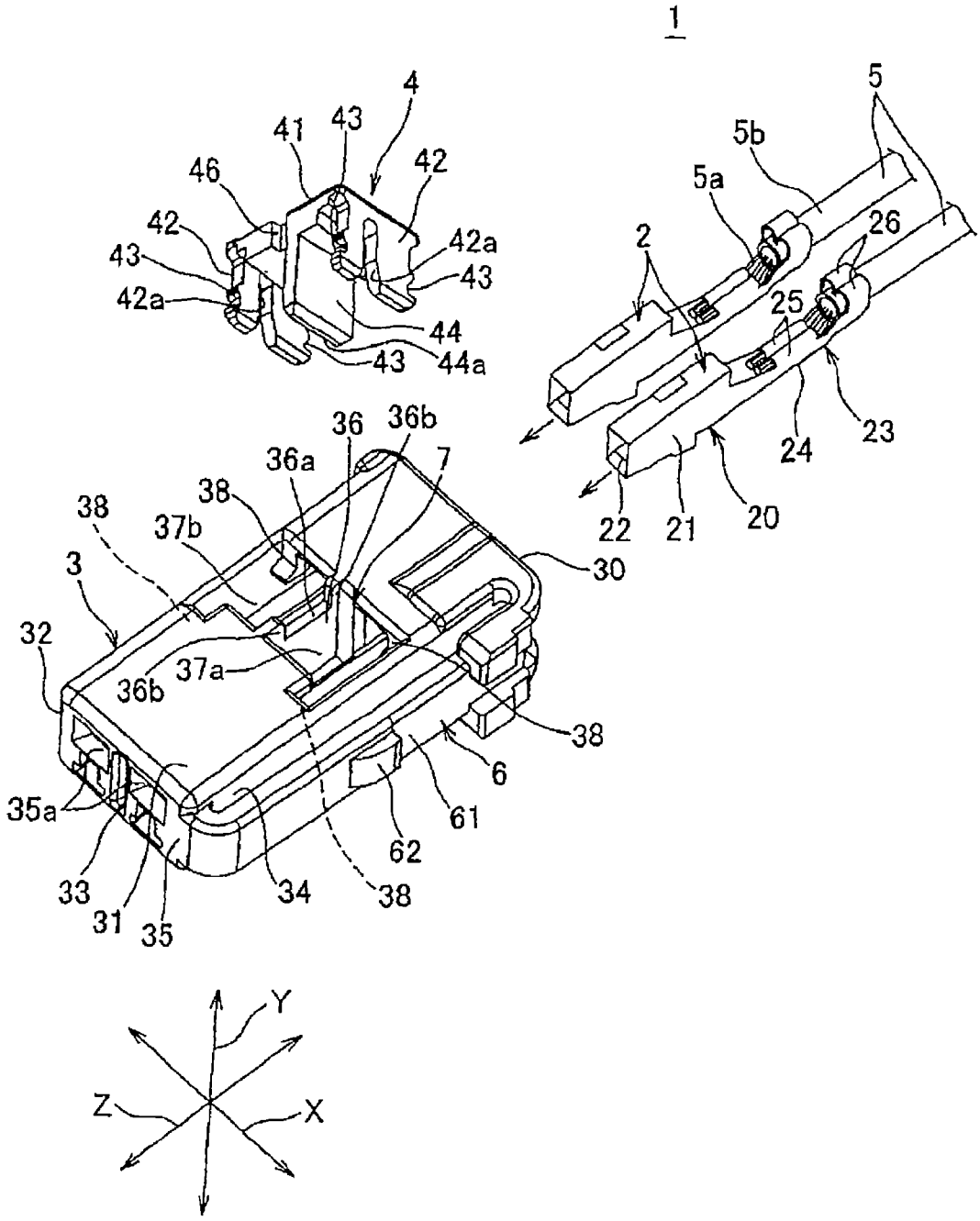
FIG. 3 is an exploded perspective view of the connector of FIG. 1.

As shown in FIGS. 1 to 3, the connector 1 comprises two metal terminals 2 electrically connected respectively to end portions of wires 5 forming the wire harness, a synthetic resin-made connector housing 3 having two juxtaposed terminal accommodating chambers 37*a* and 37*b* for respectively receiving the metal terminals 2, and a synthetic resin-made spacer 4 spacer which is inserted into the connector housing 3 through an opening 7 formed through an outer wall 31 of the connector housing 3 facing the two terminal accommodating chambers 37*a* and 37*b*, and holds the two metal terminals 2, thereby preventing the metal terminals 2 from withdrawal from the respective terminal accommodating chambers 37*a* and 37*b*.

As shown in FIG. 3, the metal terminal 2 is obtained by applying press-working or the like to a metal sheet. This metal terminal 2 includes a female-type electrical connection portion 20 for electrical connection to a male-type metal terminal of a mating connector (not shown), and a wire connection portion 23 for electrical connection to the end portion of the wire 5. The electrical connection portion 20 includes a tubular portion 21 for receiving the male-type metal terminal, and a spring portion 22 for urging the male-type metal terminal, inserted in the tubular portion 21, against an inner surface of the tubular portion 21. The wire connection portion 23 includes a bottom wall 24 extending from the tubular portion 21, a pair of conductor press-fastening tabs 25 formed in an upstanding manner respectively on opposite side edges of the bottom wall 24 spaced from each other in a widthwise direction thereof, and a pair of sheath press-fastening tabs 26 formed in an upstanding manner respectively on the opposite edges of the bottom wall 24 spaced from each other in the widthwise direction thereof. The pair of conductor press-fastening tabs 25 are press-fastened to a conductor (that is, core wires 5*a*) of the wire 5 to be electrically connected thereto. The pair of sheath press-fastening tabs 26 are press-fastened to a sheath 5*b* of the wire 5 covering the core wires 5*a*, and are mechanically connected thereto.

Figure 4:
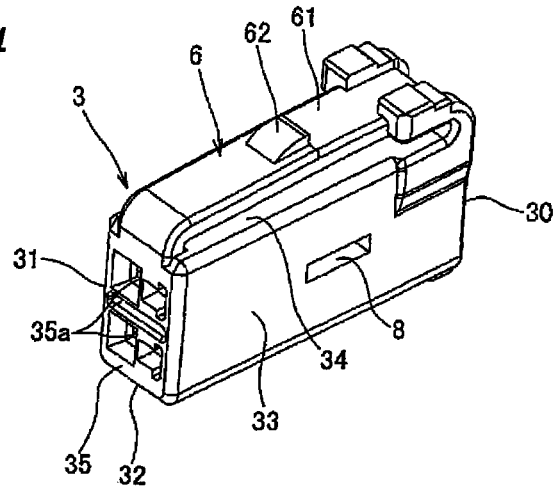
FIG. 4 is a perspective view showing a reverse side of a connector housing shown in FIG. 3.

As shown in FIGS. 3 and 4, the connector housing 3 are formed into a box-like shape by a plurality of outer walls 30, 31, 32, 33, 34 and 35. The outer walls 31 and 33 are disposed in opposed relation to each other in a direction of a height of the connector housing 3, that is, in a direction of arrow Y. The outer walls 32 and 34 are disposed in opposed relation to each other in a direction of a width of the connector housing 3, that is, in a direction of arrow X. The outer walls 30 and 35 are disposed in opposed relation to each other in a direction of a length of the connector housing 3, that is, in a direction of arrow Z.

This connector 1 is fitted to the mating connector in the longitudinal direction of the connector housing 3, that is, in the direction of arrow Z. Through holes 35*a* into which the male metal terminals of the mating connector are inserted are formed through the outer wall 35. Insertion holes for the insertion of the respective metal terminals 2 thereinto are formed through the outer wall 30.

A lock arm 6 for retaining engagement with the mating connector is formed on the outer surface of the outer wall 34. The lock arm 6 includes an arm portion 61 in the form of a center impeller-type plate, and a lock portion 62 formed on and projecting from the outer surface of the arm portion 61.

As described above, the opening 7 for the insertion of the spacer 4 therethrough is formed in the outer wall 31, the opening 7 having a generally square shape when seen from the direction of arrow Y. Namely, the outer wall 31 corresponds to "first outer wall" recited in the appended claims. Retaining reception portions 38 for retaining engagement with retaining portions 42 of the spacer 4 are formed within the connector housing 3, and are disposed respectively at four corners of the opening 7.

As shown in FIGS. 2 and 4, a second opening 8 is formed through the outer wall 33 opposed to the outer wall 31. Namely, the outer wall 33 corresponds to "second outer wall" recited in the appended claims. The second opening 8 receives a distal end portion 44*a* of a superposing wall 44 of the spacer 4.

The two terminal accommodating chambers 37*a* and 37*b* are formed by the outer walls 30, 31, 32, 33, 34 and 35 of the connector housing 3 and a partition wall 36 dividing a space defined by these outer walls 30, 31, 32, 33, 34 and 35. The two terminal accommodating chambers 37*a* and 37*b* are disposed side-by-side in the direction X perpendicular to the direction (that is, the direction of arrow Z) of insertion of the metal terminals 2 into the respective terminal accommodating chambers 37*a* and 37*b*. Namely, the two terminal accommodating chambers are aligned in parallel in the direction of arrow X.

The partition wall 36 of a plate-shape extends perpendicularly from the inner surface of the outer wall 33 toward the outer wall 31, that is, toward the opening 7. That edge of the partition wall 36 disposed close to the opening 7 is disposed flush with the outer surface of the outer wall 31. A notch 36*a* is formed in the portion of the partition wall 36 facing the opening 7, that is, in the edge of the partition wall 36 disposed close to the opening 7. With this construction, when the spacer 4 is not attached to the connector housing, the two terminal accommodating chambers 37*a* and 37*b* communicate with each other at their portions disposed close to the opening 7.

Figure 5:
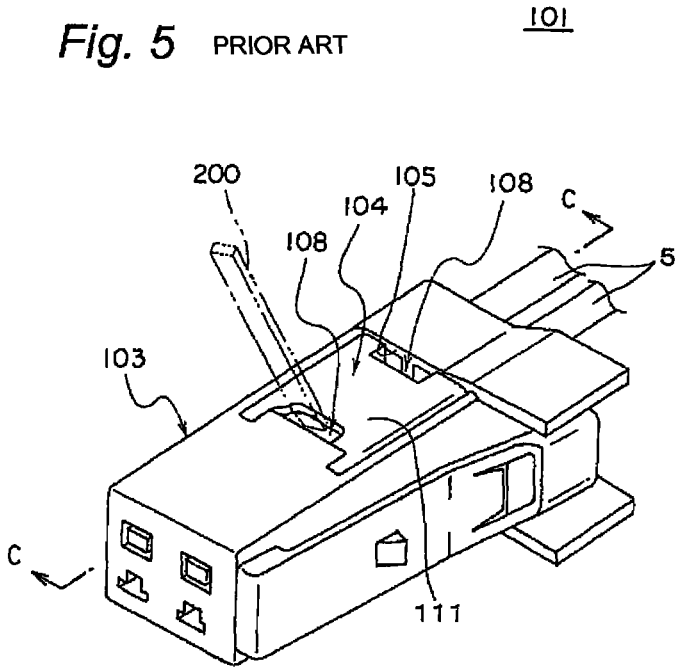
Fig. 5 PRIOR ART
FIG. 5 is a perspective view of a conventional connector.
Figure 6:
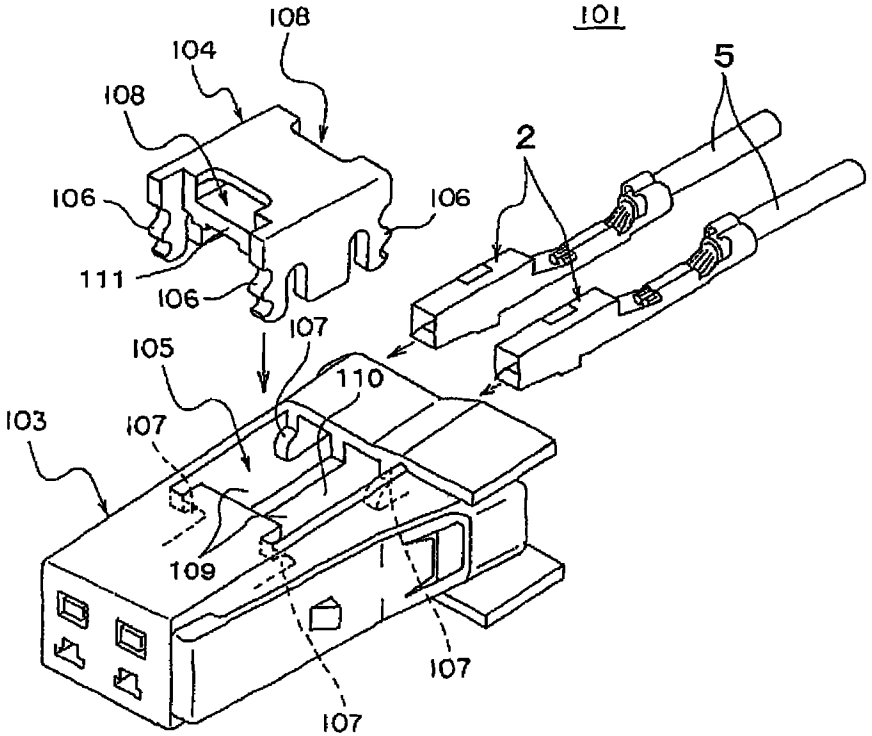
Fig. 6 PRIOR ART
FIG. 6 is an exploded perspective view of the connector of FIG. 5.
Figure 7:
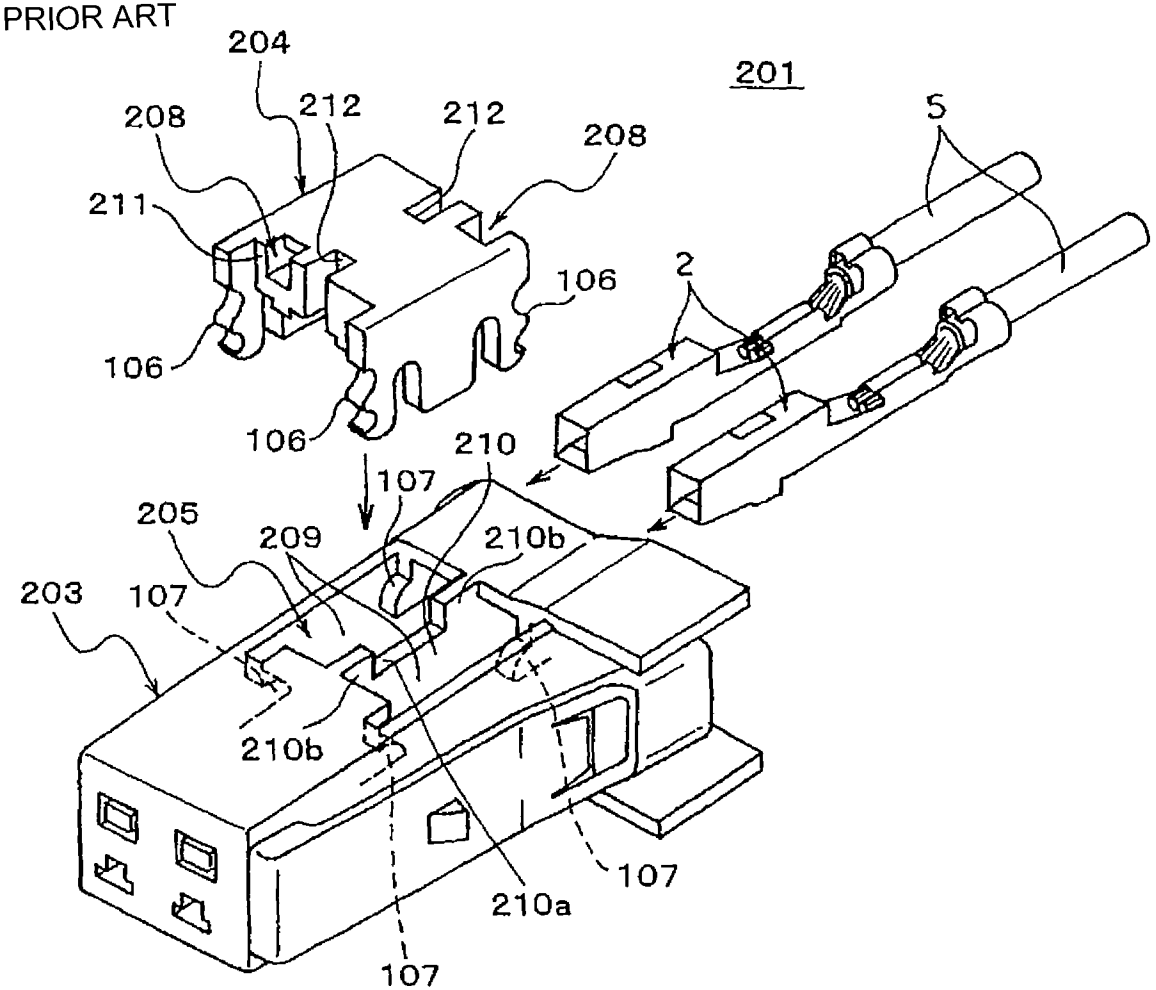
Fig. 7 PRIOR ART
FIG. 7 is an exploded perspective view of another conventional connector.
Figure 8:
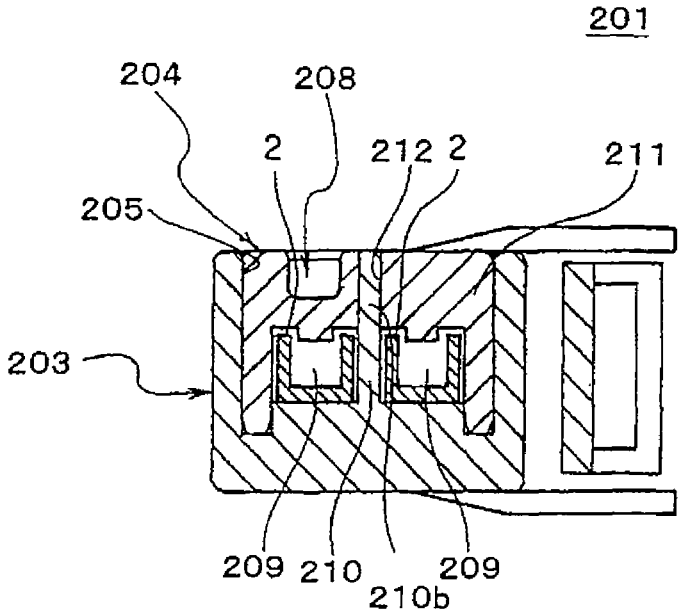
Fig. 8 PRIOR ART
FIG. 8 is a cross-sectional view of the connector of FIG. 7.

The spacer 4 is inserted into the connector housing 3, that is, into the two terminal accommodating chambers 37*a* and 37*b* in the direction of arrow Y perpendicular to the direction (that is, the direction of arrow Z) of insertion of the metal terminals 2 into the respective terminal accommodating chambers 37*a* and 37*b*, and holds the two metal terminals 2, thereby preventing the metal terminals 2 from withdrawal from the respective terminal accommodating chambers 37*a* and 37*b*. As shown in FIGS. 1 to 3, the spacer 4 includes a body portion 41 for abutting against the two metal terminals 2, the pair of retaining portions 42 perpendicularly extending respectively from opposite ends of the body portion 41 spaced from each other in the direction of arrow X, an insertion port 45 for the insertion of a jig (see FIG. 5) used when removing the spacer 4 from the connector housing 3, and the plate-like superposing wall 4 extending perpendicularly from a central portion (in the direction of arrow X) of the body portion 41.

The body portion 41 is formed into a generally plate-shape identical in plane shape to the opening 7. A pair of slits 46 are formed respectively in opposite end portions of the body portion 41 spaced from each other in the direction of arrow Z, and those portions 36*b* of the partition wall 36 disposed respectively at opposite ends of the notch 36*a* are fitted in these slits 46, respectively. The pair of slits 46 are recessed respectively from the opposite edges of the body portion 41 spaced from each other in the direction of arrow Z.

Opposite end portions 43 of each of the pair of retaining portions 42 which are spaced from each other in the direction of arrow Z are formed into a wavy shape so as to be retainingly engaged with the respective retaining reception portions 38. Each of the retaining portions 42 has a slit 42*a* extending from that edge thereof remote from the body portion 41 toward the body portion 41. The spacer 4 having the pair of retaining portions 42 is press-fitted into the connector housing 3 through the opening 7, and the pair of retaining portions 42 are retainingly engaged with the four retaining reception portions 38, thereby fixing the spacer 4 to the connector housing 3.

The insertion port 45 is the hole formed in both of the outer surface of the body portion 41 and the edge of the body portion 41 as shown in FIG. 1. This insertion port 45 is provided so as not to extend over the two terminal accommodating chambers 37*a* and 37*b*, and communicates only with one terminal accommodating chamber 37*b*. Communication between the insertion port 45 and the other terminal accommodating chamber 37*a* is interrupted by the portion 36*b* of the partition wall 36, the body portion 41 of the spacer 4 and the superposing wall 44 of the spacer 4. For removing the spacer 4 from the connector housing 3, the jig is inserted into the insertion port 45, and then this jig is brought down to prize the spacer 4 out (see FIG. 5).

When the spacer 4 is inserted in the connector housing 3, the superposing wall 44 is superposed on the partition wall 36 separating the terminal accommodating chambers 37*a* and 37*b* from each other, as shown in FIG. 2. Also, when the spacer 4 is inserted in the connector housing 3, the distal end portion 44*a* of the superposing wall 44 remote from the body portion 41 is located within the second opening 8 formed in the outer wall 33. In this embodiment, when the spacer 4 is inserted in the connector housing 3, the distal end portion 44*a* is located within the second opening 8, and is disposed flush with the outer surface of the outer wall 33.

Furthermore, in the present invention, the width of the terminal accommodating chamber 37*a* through which the superposing wall 44 is passed is larger than the width of the terminal accommodating chamber 37*b* through which the superposing wall 44 is not passed by an amount equal to the thickness of the superposing wall 44. Namely, when the width of the terminal accommodating chamber 37*b* from the inner surface of the outer wall 32 to the surface of the partition wall 36 is represented by m, and the thickness of the superposing wall 44 is represented by n, the width of the terminal accommodating chamber 37*a* from the inner surface of the outer wall 34 to the surface of the partition wall 36 is represented by (m+n), as shown in FIG. 2. In FIG. 2, two dots-and-dash line S is an imaginary line passing through the center of the connector housing 3 with respect to the direction of the width thereof, that is, the direction of arrow X. As shown in FIG. 2, the partition wall 36 is disposed to be offset from the two dots-and-dash line S. The two terminal accommodating chambers 37*a* and 37*b* have such widths, and with this construction an extra space is prevented from being formed within each terminal accommodating chamber 37*a*, 37*b*, and the connector housing 3 is prevented from increasing in size.

For assembling the connector 1 of the above construction, first, the metal terminals 2 are secured to the end portions of the wires 5, respectively, and these metal terminals 2 are inserted into the terminal accommodating chambers 37*a* and 37*b*, respectively. Then, the spacer 4 is press-fitted into the connector housing 3 through the opening 7, and is attached to the connector housing 3. Thus, the connector 1 is assembled.

For disassembling the connector 1, the jig is inserted into the insertion port 45 as described above, and then this jig is brought down to prize the spacer 4 out of the connector housing 3, and thereafter the metal terminals 2 are withdrawn from the terminal accommodating chambers 37*a* and 37*b*, thus disassembling the connector 1. When the spacer 4 is thus removed, the metal terminals 2 can be easily withdrawn from the respective terminal accommodating chambers 37*a* and 37*b*.

In the connector 1 of the present invention, the partition wall 36, extending perpendicularly from the outer wall 33 toward the outer wall 31, and the superposing wall 44 extending toward the outer wall 33 from the portion of the spacer 4 disposed close to the outer wall 31 are disposed between the adjoining terminal accommodating chambers 37*a* and 37*b* in such a manner that the partition wall 36 and the superposing wall 44 extend in the opposite directions, respectively. Therefore, in order that a foreign matter such as metallic power or the like intruding into the connector housing 3 through the insertion port 45, a clearance between the opening 7 and the spacer 4, etc., can move from one of the adjoining terminal accommodating chambers 37*a* and 37*b* to the other, the foreign matter must advance on the surface of the partition wall 36 and the surface of the superposing wall 4 as switch-backing, and there is hardly a possibility that the foreign matter reaches the other of the terminal accommodating chambers 37*a* and 37*b* from the one of the terminal accommodating chambers 37*a* and 37*b*. Also, during the time when the foreign matter moves on the surface of the partition wall 36 and the surface of the superposing wall 44, the foreign matter is discharged to the exterior of the connector housing 3 through the second opening 8, and therefore there is hardly a possibility that the foreign matter reaches the other of the terminal accommodating chambers 37*a* and 37*b* from the one of the terminal accommodating chambers 37*a* and 37*b*. Therefore, a small piece of foreign matter can be positively prevented from depositing on both of the adjoining metal terminals 2. Therefore, in the connector 1, the short-circuiting between the metal terminals which would be caused by the foreign matter intruding into the connector housing 3 can be positively prevented.

Although the above embodiment is directed to the connector 1 provided with the two metal terminals 2, the connector of the present invention may be provided with three or more metal terminals 2.

The above embodiment merely shows a representative example of the present invention, and the present invention is not limited to the above embodiment. Namely, various modifications can be made without departing from the subject matter of the invention.

The present application is based on Japanese Patent Application No. 2010-023912 filed on Feb. 5, 2010, the contents of which are incorporated herein by way of reference.

INDUSTRIAL APPLICABILITY

The present invention is extremely useful in providing a connector in which the effect of preventing the short-circuiting between metal terminals due to the deposition of a foreign matter is further enhanced.

REFERENCE SIGNS LIST

1 connector
2 metal terminal
3 connector housing
4 spacer
7 opening
8 second opening
31 first outer wall
33 second outer wall
36 partition wall
37*a*, 37*b* terminal accommodating chamber
44 superposing wall
44*a* distal end portion

The invention claimed is:

1. A connector comprising:

a plurality of metal terminals;

a connector housing, configured to respectively receive the metal terminals, having a plurality of terminal accommodating chambers which are aligned in parallel therein and are partitioned with a partition wall from each other, and having a first outer wall which is formed with a first opening and a second outer wall which is opposite to the first outer wall and is formed with a second opening; and a spacer, configured to be inserted into the plurality of terminal accommodating chambers through the first opening so as to hold the plurality of metal terminals so that the metal terminals are prevented from withdrawal from the connector housing, and having a superposing wall which extends toward the second outer wall, wherein the superposing wall is configured to superpose on the partition wall and a distal end portion of the superposing wall is located within the second opening, in a state where the spacer is inserted in the terminal accommodating chambers.

2. The connector as set forth in claim 1, wherein a width of one of the terminal accommodating chambers through which the superposing wall is passed is larger than a width of another one of the terminal accommodating chambers through which the superposing wall is not passed by a thickness of the superposing wall.

3. The connector as set forth in claim 1, wherein the spacer has an insertion port for insertion of a jig used when removing the space spacer from the connector housing, and the insertion port communicates with only one of the terminal accommodating chambers.

4. The connector as set forth in claim 1, wherein the partition wall has a notch on an edge facing the first opening, the spacer is formed with a pair of slits which extend from opposite end portions of the spacer in a direction orthogonal to a direction in which the terminal accommodating chambers are aligned, and in the state where the spacer is inserted in the terminal accommodating chambers, end portions of the partition wall which are adjacent to opposite ends the notch are configured to be inserted into the slits respectively.

* * * * *